US005930930A

United States Patent [19]

Howell

[11] Patent Number: 5,930,930

[45] Date of Patent: Aug. 3, 1999

[54] GUN LOCKING MECHANISM

[76] Inventor: Duane A. Howell, 244 North St. Paul, Wichita, Kans. 67203

[21] Appl. No.: 08/961,504

[22] Filed: Oct. 30, 1997

[51] Int. Cl.[6] ..... F41A 17/04

[52] U.S. Cl. ..... 42/70.11; 42/70.08

[58] Field of Search ..... 42/66, 70.11, 70.08

[56] References Cited

U.S. PATENT DOCUMENTS

| | | | |
|---|---|---|---|
| 2,803,910 | 8/1957 | Lyle | 42/70.11 |
| 3,735,519 | 5/1973 | Fox | 42/70 |
| 4,658,529 | 4/1987 | Bertolini | 42/70.08 |
| 4,987,693 | 1/1991 | Brooks | 42/70.11 |
| 5,090,148 | 2/1992 | Brooks | 42/70.11 |

*Primary Examiner*—Charles T. Jordan
*Assistant Examiner*—Chris J. Brown

[57] ABSTRACT

A gun locking security device is provided including a combination assembly with a plurality of dials having a central extent with a plurality of numbers formed on a periphery thereof. The dials are rotatably coupled in coaxial relationship within an interconnection of a barrel portion and a handle portion of a gun. A safety mechanism is provided for allowing the firing of the gun upon the actuation thereof. An actuator assembly is connected between the combination assembly and the safety mechanism for actuating the safety mechanism only upon the rotation of the dials such that a predetermined combination of numbers is selected.

8 Claims, 2 Drawing Sheets

GUN LOCKING MECHANISM

BACKGROUND OF THE INVENTION

1. Field of the Invention

The present invention relates to gun safeties and more particularly pertains to a new gun locking mechanism for preventing the unauthorized firing of a gun.

2. Description of the Prior Art

The use of gun safeties is known in the prior art. More specifically, gun safeties heretofore devised and utilized are known to consist basically of familiar, expected and obvious structural configurations, notwithstanding the myriad of designs encompassed by the crowded prior art which have been developed for the fulfillment of countless objectives and requirements.

Known prior art gun safeties include U. S. Pat. No. 4,763,431; U.S. Pat. No. 5,090,148; U.S. Pat. No. 4,499,681; U.S. Pat. No. 4,987,693; U.S. Pat. No. 4,457,091; and U.S. Pat. Des. No. 296,349.

In these respects, the gun locking mechanism according to the present invention substantially departs from the conventional concepts and designs of the prior art, and in so doing provides an apparatus primarily developed for the purpose of preventing the unauthorized firing of a gun.

SUMMARY OF THE INVENTION

In view of the foregoing disadvantages inherent in the known types of gun safeties now present in the prior art, the present invention provides a new gun locking mechanism construction wherein the same can be utilized for preventing the unauthorized firing of a gun.

The general purpose of the present invention, which will be described subsequently in greater detail, is to provide a new gun locking mechanism apparatus and method which has many of the advantages of the gun safeties mentioned heretofore and many novel features that result in a new gun locking mechanism which is not anticipated, rendered obvious, suggested, or even implied by any of the prior art gun safeties, either alone or in any combination thereof.

To attain this, the present invention comprises a gun having a generally horizontally oriented barrel portion, a generally vertically oriented handle portion, and a trigger formed therebetween. The trigger serves to cock a hammer of the gun rearwardly upon the depression thereof. The gun further has a rectangular slot formed between opposite sides of the gun. As best shown in FIG. 2, a combination assembly is provided including a plurality of dials having a central extent with a first diameter. A plurality of numbers are formed on a periphery of the central extent. Each dial further has a pair of side extents each with a smooth circular periphery having a second diameter less than the first diameter. Each side extent is equipped with a single flat spot formed therein. As shown in FIG. 1, the dials are rotatably coupled in coaxial relationship within an interconnection of the barrel portion and handle portion of the gun. As such, only a single number of the central extent protrudes from the gun. Further, an axis about which the dials are formed resides in alignment with the trigger when not depressed. With reference now to FIGS. 3 & 4, shown is a safety shaft slidably situated within the slot of the gun. The shaft has a bottom surface with a first semicircular cut out formed therein at a central extent thereof. Associated therewith is a second cut out formed therein adjacent an end thereof. The safety shaft has a first orientation wherein the first semicircular cut out is in alignment with the hammer for allowing contact with a bullet. Further, the safety shaft has a second orientation wherein the shaft precludes contact with the bullet. Finally, an actuator assembly is provided including an inverted U-shaped lower member with a pair of arms extending in abutment with the side extents of the dials of the combination assembly. A post extends upwardly from the lower member and resides in abutment with the bottom surface of the safety shaft. During use, the post is adapted to be inserted within the second cut out to maintain the same in the first orientation thereof. The actuator assembly further has a plurality of springs situated between an interior surface of the gun and the U-shaped lower member for urging the U-shaped lower member toward the dials. During use, upon the rotation of the dials such that a predetermined combination of numbers protrude from the gun, the arms of the U-shaped member abut the flat spots of the dials. This removes the post from the second cut out of the safety shaft so that the shaft may be slid to the second orientation thereof for allowing use of the gun.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gun locking mechanism apparatus and method which has many of the advantages of the gun safeties mentioned heretofore and many novel features that result in a new gun locking mechanism which is not anticipated, rendered obvious, suggested, or even implied by any of the prior art gun safeties, either alone or in any combination thereof.

It is another object of the present invention to provide a new gun locking mechanism which may be easily and efficiently manufactured and marketed.

It is a further object of the present invention to provide a new gun locking mechanism which is of a durable and reliable construction.

An even further object of the present invention is to provide a new gun locking mechanism which is susceptible of a low cost of manufacture with regard to both materials and labor, and which accordingly is then susceptible of low prices of sale to the consuming public, thereby making such gun locking mechanism economically available to the buying public.

Still yet another object of the present invention is to provide a new gun locking mechanism which provides in the apparatuses and methods of the prior art some of the advantages thereof, while simultaneously overcoming some of the disadvantages normally associated therewith.

Still another object of the present invention is to provide a new gun locking mechanism for preventing the unauthorized firing of a gun.

Even still another object of the present invention is to provide a new gun locking mechanism that includes a combination assembly with a plurality of dials having a central extent with a plurality of numbers formed on a periphery thereof. The dials are rotatably coupled in coaxial relationship within an interconnection of a barrel portion and a handle portion of a gun. A safety mechanism is provided for allowing the firing of the gun upon the actuation thereof. An actuator assembly is connected between the combination assembly and the safety mechanism for actuating the safety mechanism only upon the rotation of the dials such that a predetermined combination of numbers is selected.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
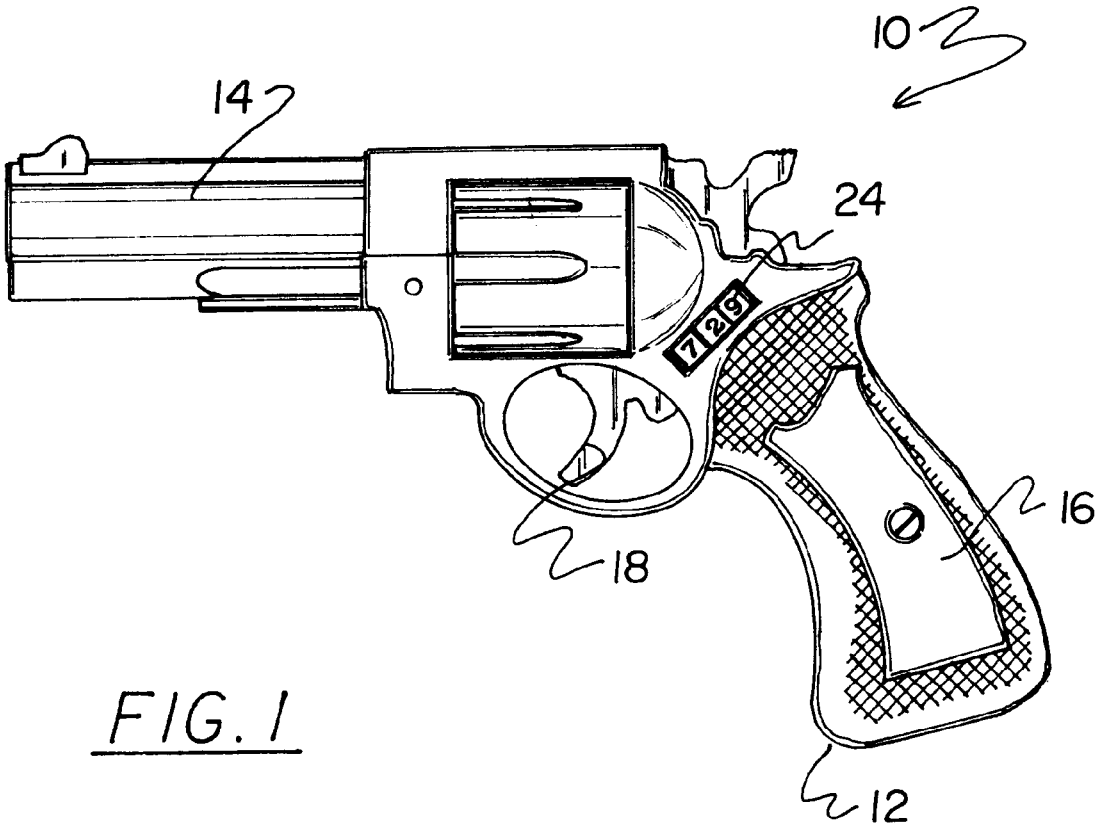
FIG. 1 is a side view of a new gun locking mechanism according to the present invention.

With reference now to the drawings, and in particular to FIGS. 1 through 4 thereof, a new gun locking mechanism embodying the principles and concepts of the present invention and generally designated by the reference numeral 10 will be described.

The present invention, as designated as numeral 10, includes a gun 12 having a generally horizontally oriented barrel portion 14, a generally vertically oriented handle portion 16, and a trigger 18 formed therebetween. The trigger serves to cock a hammer of the gun rearwardly upon the depression thereof. The gun further has a rectangular slot 20 formed between opposite sides of the gun for reasons that will become apparent hereinafter.

Figure 2:
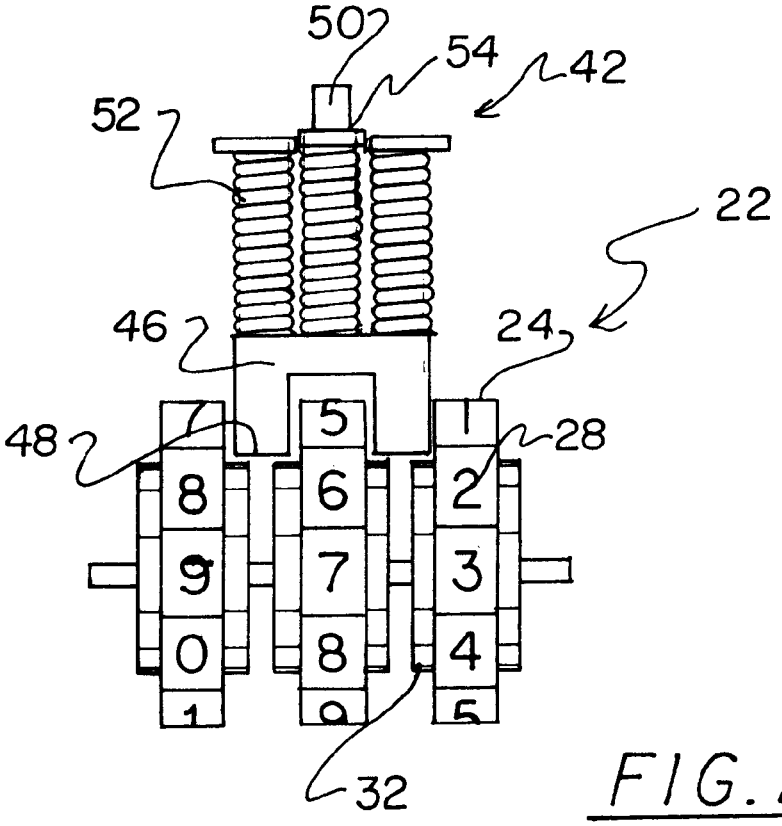
FIG. 2 is a front view of the combination assembly of the present invention.

As best shown in FIG. 2, a combination assembly 22 is provided including a plurality of dials 24 having a central extent with a first diameter. A plurality of numbers 28 are formed on a periphery of the central extent. To facilitate the manual rotation of the dials, each central extent is equipped with a protrusion 30 situated between each number.

Each dial further has a pair of side extents 32 each with a smooth circular periphery having a second diameter less than the first diameter. Each side extent is equipped with a single flat spot 34 formed therein. As shown in FIG. 1, the dials are rotatably coupled in coaxial relationship within an interconnection of the barrel portion and handle portion of the gun. As such, only a single number of the central extent protrudes from the gun at a time. Further, an axis about which the dials are formed resides in alignment with the trigger when not depressed.

Figure 3:
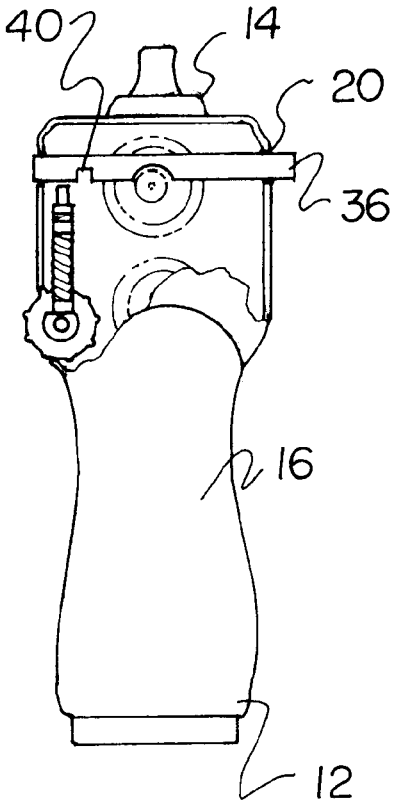
FIG. 3 is a rear view of the present invention with the safety shaft in one of the orientations thereof.
Figure 4:
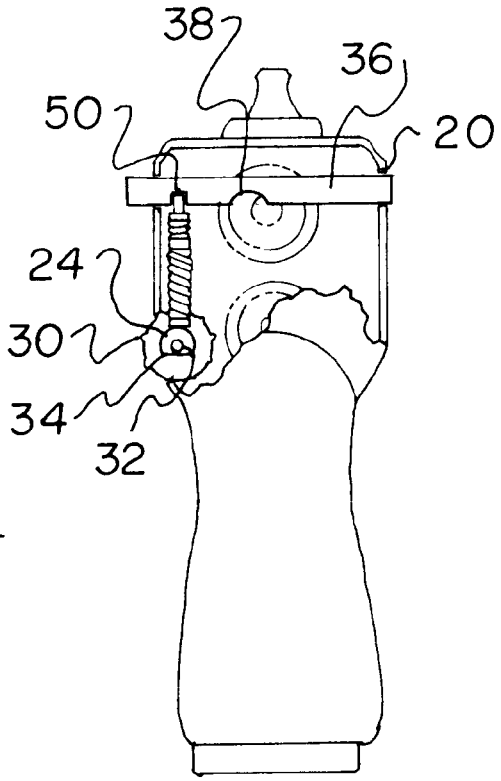
FIG. 4 is a rear view of the present invention with the safety shaft in another orientation.

With reference now to FIGS. 3 & 4, shown is a safety shaft 36 slidably situated within the slot of the gun. The shaft has a bottom surface with a first semicircular cut out 38 formed therein at a central extent thereof. Associated therewith is a second cut out 40 formed therein adjacent an end thereof. The safety shaft has a first orientation wherein the first semicircular cut out is in alignment with the hammer for allowing contact with a bullet. Further, the safety shaft has a second orientation wherein the shaft precludes contact with the bullet. It should be noted that various other types of safety means such as a conventional safety may be employed for the purpose of precluding the firing of the gun. The type of safety means employed depends on the type of gun being used.

Finally, an actuator assembly 42 is provided including an inverted U-shaped lower member 46 with a pair of arms 48 extending in abutment with the side extents of the dials of the combination assembly. A post 50 extends upwardly from the lower member and resides in abutment with the bottom surface of the safety shaft. In the alternative, the U-shaped lower member may be replaced with a member of various other configurations. In use, the post is adapted to be inserted within the second cut out to maintain the same in the first orientation thereof. The actuator assembly further has a plurality of springs 52 situated between an interior surface of the gun and the U-shaped lower member for urging the U-shaped lower member toward the dials. Preferably, the post is situated through a bore 54 formed in the gun to maintain the actuator assembly in sliding relationship therewith along a single axis.

During use, upon the rotation of the dials such that a predetermined combination of numbers protrude from the gun, the arms of the U-shaped member abut the flat spots of the dials. This removes the post from the second cut out of the safety shaft so that the shaft may be freely slid to the second orientation thereof for allowing use of the gun.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gun locking security device comprising, in combination:

a gun having a generally horizontally oriented barrel portion, a generally vertically oriented handle portion, and a trigger formed therebetween, the trigger adapted to cock a hammer of the gun rearwardly upon the depression thereof, the gun further having a rectangular slot formed between opposite sides of the gun;

a combination assembly including a plurality of dials having a central extent with a first diameter and a plurality of numbers formed on a periphery thereof and a pair of side extents each with a smooth circular periphery having a second diameter less than the first diameter with the exception of a single flat spot formed therein, the dials rotatably coupled in coaxial relationship within an interconnection of the barrel portion and handle portion of the gun such that only a single number of the central extent protrudes from the gun and an axis about which the dials are formed resides in alignment with the trigger when not depressed;

a safety shaft slidably situated within the slot of the gun with a bottom surface having a first semicircular cut out formed therein at a central extent thereof and a second cut out formed therein adjacent an end thereof, the safety shaft having a first orientation wherein the first semicircular cut out is in alignment with the hammer for allowing contact with a bullet and a second orientation wherein the shaft precludes contact with the bullet;

an actuator assembly including an inverted U-shaped lower member with a pair of arms extending in abutment with the side extents of the dials of the combination assembly and a post extending upwardly therefrom in abutment with the bottom surface of the safety shaft and adapted to be inserted within the second cut out to maintain the same in the first orientation thereof, the actuator assembly further having a plurality of springs situated between an interior surface of the gun and the U-shaped lower member for urging the U-shaped lower member toward the dials, whereby upon the rotation of the dials such that a predetermined combination of numbers protrude from the gun, the arms of the U-shaped member abut the flat spots of the dials thereby removing the post from the second cut out of the safety shaft so that the shaft may be slid to the second orientation thereof for allowing use of the gun.

2. A gun locking security device comprising:

a gun having a generally horizontally oriented barrel portion, a generally vertically oriented handle portion, and a trigger formed therebetween, the trigger adapted to cock a hammer of the gun rearwardly upon the depression thereof;

a combination assembly including a plurality of dials having a central extent with a plurality of numbers formed on a periphery thereof, the dials rotatably coupled in coaxial relationship within an interconnection of the barrel portion and handle portion of the gun;

a safety means for allowing the firing of the gun upon the actuation thereof; and an actuator assembly connected between the combination assembly and the safety means for actuating the safety means only upon the rotation of the dials such that a predetermined combination of numbers is selected;

wherein an axis about which the dials are formed resides in alignment with the trigger when not depressed.

3. A gun locking security device as set forth in claim 2 wherein the actuator assembly includes an inverted U-shaped lower member with a pair of arms extending in abutment with side extents of the dials of the combination assembly and a post extending upwardly therefrom in abutment with the safety means.

4. A gun locking security device as set forth in claim 2 wherein the safety means includes a shaft slidably situated within a slot of the gun with a bottom surface having a semicircular cut out formed therein.

5. A gun locking security device as set forth in claim 2 wherein only a single number of the central extent protrudes from the gun at a time.

6. A gun locking security device comprising:

a gun having a generally horizontally oriented barrel portion, a generally vertically oriented handle portion, and a trigger formed therebetween, the trigger adapted to cock a hammer of the gun rearwardly upon the depression thereof;

a combination assembly including a plurality of dials having a central extent with a plurality of numbers formed on a periphery thereof, the dials rotatably coupled in coaxial relationship within an interconnection of the barrel portion and handle portion of the gun;

a safety means for allowing the firing of the gun upon the actuation thereof; and an actuator assembly connected between the combination assembly and the safety means for actuating the safety means only upon the rotation of the dials such that a predetermined combination of numbers is selected;

wherein only a single number of the central extent of each of the dials protrudes from the gun at a time.

7. A gun locking security device comprising:

a gun having a generally horizontally oriented barrel portion, a generally vertically oriented handle portion, and a trigger formed therebetween, the trigger adapted to cock a hammer of the gun rearwardly upon the depression thereof;

a combination assembly including a plurality of dials having a central extent with a plurality of numbers formed on a periphery thereof, the dials rotatably coupled in coaxial relationship within an interconnection of the barrel portion and handle portion of the gun;

a safety means for allowing the firing of the gun upon the actuation thereof; and an actuator assembly connected between the combination assembly and the safety means for actuating the safety means only upon the rotation of the dials such that a predetermined combination of numbers is selected;

wherein the actuator assembly includes an inverted U-shaped lower member with a pair of arms extending in abutment with side extents of the dials of the combination assembly and a post extending upwardly therefrom in abutment with the safety means.

8. A gun locking security device comprising:

a gun having a generally horizontally oriented barrel portion, a generally vertically oriented handle portion, and a trigger formed therebetween, the trigger adapted to cock a hammer of the gun rearwardly upon the depression thereof;

a combination assembly including a plurality of dials having a central extent with a plurality of numbers formed on a periphery thereof, the dials rotatably coupled in coaxial relationship within an interconnection of the barrel portion and handle portion of the gun;

a safety means for allowing the firing of the gun upon the actuation thereof; and an actuator assembly connected between the combination assembly and the safety means for actuating the safety means only upon the rotation of the dials such that a predetermined combination of numbers is selected;

wherein the safety means includes a shaft slidably situated within a slot of the gun with a bottom surface having a semicircular cut out formed therein.

* * * * *